United States Patent [19]

Lindley et al.

[11] Patent Number: 5,044,105

[45] Date of Patent: Sep. 3, 1991

[54] LOCKING DEVICE

[75] Inventors: Adrian Q. Lindley, Grantham; Roger Bellamy, Loughborough, both of England

[73] Assignee: Camloc (U.K.) Limited, Leicester, England

[21] Appl. No.: 663,885

[22] PCT Filed: Jul. 17, 1990

[86] PCT No.: PCT/GB90/01095

§ 371 Date: Mar. 15, 1991

§ 102(e) Date: Mar. 15, 1991

[87] PCT Pub. No.: WO91/01476

PCT Pub. Date: Feb. 7, 1991

[30] Foreign Application Priority Data

Jul. 17, 1989 [GB] United Kingdom ..... 8916310

[51] Int. Cl.[5] ..... F41A 17/44

[52] U.S. Cl. ..... 42/70.11; 285/80; 403/15; 403/324

[58] Field of Search ..... 42/70.11; 285/80, 309, 285/312; 403/15, 324; 138/89

[56] References Cited

U.S. PATENT DOCUMENTS

| | | | |
|---|---|---|---|
| 37,946 | 3/1863 | Bonanzo | 42/70.11 |
| 1,458,271 | 6/1923 | Clark | 109/30 |
| 2,819,733 | 1/1958 | Maisch | 42/70.11 |
| 2,937,666 | 3/1960 | Maisch | 42/70.11 |
| 3,193,959 | 7/1965 | Jaycox | 42/70.11 |
| 4,245,567 | 1/1981 | Herrmann | 109/64 |
| 4,827,649 | 3/1989 | Sheehan | 42/70.11 |

FOREIGN PATENT DOCUMENTS 8910528 2/1989 World Int. Prop. O. .

*Primary Examiner*—Michael J. Carone

*Attorney, Agent, or Firm*—Watson, Cole, Grindle & Watson

[57] ABSTRACT

A locking device suitable for use in a gun to prevent unauthorized use of the gun includes a key operated lock (3) operable to expand a ring (8) into locking engagement with the gun chamber. In order to prevent removal of the device by applying force to the muzzle end of the device locking pins (14) are mounted in radial bores (11) to be driven radially outwardly by a tapered piston (18) if the piston is driven away from the muzzle end. An explosvie cartridge (23) is detonated by a firing pin (25) if force is applied to an end plate (26) thereby driving the piston in the desired manner.

8 Claims, 1 Drawing Sheet

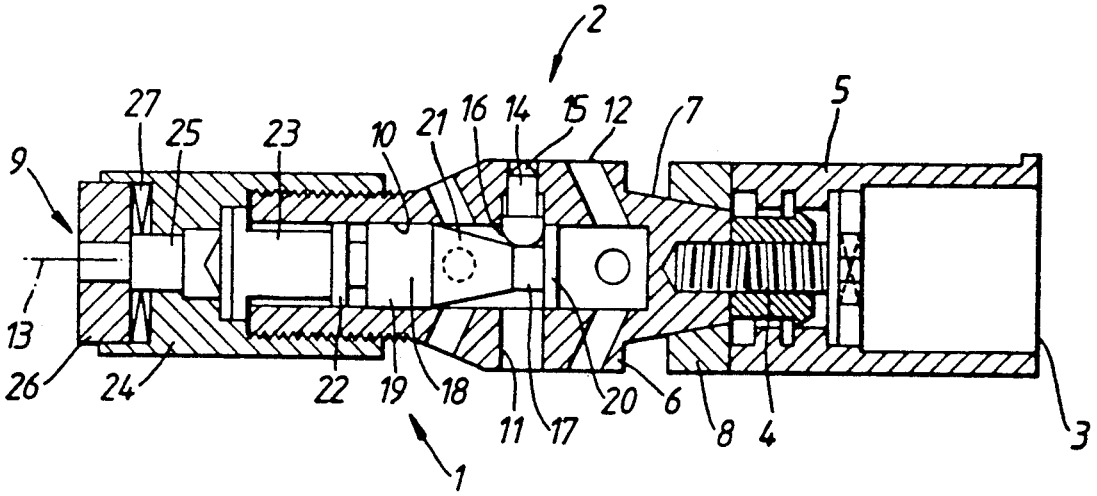
2
27
25
23
10
21
16
14
15
12
7
5
9
13
26
24
22
19
18
11
17
20
6
8
4
3
1

LOCKING DEVICE

This invention relates to a locking device which, upon actuation, is locked to a hollow body within which the device is situated. Although of general applicability the preferred embodiment of locking device is particularly suitable for forming part of a safety device for firearms, the safety device being adapted to be secured by a key within the chamber of a firearm and to be locked permanently to the chamber of the firearm upon actuation of the locking device of the invention.

According to one aspect of the present invention there is provided a locking device which, upon actuation, is locked to a hollow body within which the device is situated, the locking device comprising: a body having a central longitudinal bore and a plurality of radial passages extending from the bore radially outwardly to the surface of the body; a locking pin located in each passage with the radially inner end of each pin located extending into the bore; an actuating member located in the bore, the actuating member having a cylindrical region and a tapering region which tapers inwardly from the cylindrical region and being positioned such that upon axial movement of the actuating member the locking pins will be cammed radially outwardly by the tapering region and thereafter locked in a radial outward position by the cylindrical region; a piston mounted in the cylinder and coupled to the actuating member for axially moving the actuating member; an explosive charge for driving the piston; and means for detonating the explosive charge in response to application of axial force to one end of the device.

A security device, particularly suitable for shot guns, has been proposed which has the overall size and configuration of a shot gun cartridge, but which incorporates a lock which enables the device to be locked into the chamber of a shot gun. One such device of this type incorporates a ring which is cammed radially outwardly by a taper to lock the security device into engagement with the wall of the chamber. Such devices suffer, however, from the disadvantage that they can often be forced from the chamber by inserting a suitable drift through the barrel from the muzzle end to apply an axial force to the security device.

If a locking device in accordance with the present invention is incorporated within the security device any attempt to remove the security device in this manner will result in detonation of the explosive charge with the result that the locking pins will be driven radially outwardly into locking engagement with the walls of the chamber. Once this has occurred extreme force will be necessary to drive the security device from the chamber, and the application of such force will result in substantial damage to the chambers of the gun.

Whilst the invention is particularly suited to use in a security device for a firearm it will be appreciated that it is of more general applicability and may be used to provide a plug which may be installed extremely rapidly within a hollow body to provide a permanent closure to the hole in which the device is located.

The invention will be better understood from the following description of a preferred embodiment thereof, given by way of example only, reference being had to the accompanying drawing wherein the single Figure illustrates schematically in partial axial cross-section a preferred embodiment of the invention.

Referring to the drawing there is illustrated an embodiment of locking device 1 according to the present invention which forms part of a security device 2 for a shot gun. The overall configuration of the security device 2 is similar to that of a conventional shot gun cartridge so that the entire security device may be positioned within the chamber of a shot gun. Once the security device has been so positioned a key operated lock 3 (which is only shown in outline in the drawing) is actuated to rotate a screw threaded member 4 which draws the lock housing 5 towards the body 6 of the locking device. An end region 7 of the body 6 is formed with a taper on which is mounted a split ring 8 having a matching taper. Movement of the lock housing 5 towards the body 6 will accordingly force the ring 8 up the taper 7 to expand the ring radially into locking engagement with the wall of the chamber of the gun. Once the ring 8 has been expanded into firm contact with the chamber wall the key is removed from the lock 3 and the shot gun is secure.

The locking device 1 prevents any attempt to drive the security device 2 from the chamber of the gun by applying a force to the end 9 of the security device using a drift which is inserted through the muzzle end of the barrel of the gun.

The locking device 1 comprises the body 6 which is machined from a suitable material, for example mild steel. The body 6 includes an axial bore 10 and a plurality of radially extending passages 11 which extend from the bore 10 to the radially outer surface 12 of the body 6. In a typical embodiment of the invention six radially extending passages 11 are provided equi-angularly spaced about the axis 13 of the locking device. In each passage 11 a locking pin 14 is provided. Only one such locking pin 14 is illustrated in the drawing in the interests of clarity. The locking pins 14 may be of any suitable material, for example hardened steel, and each has a pointed radially outer end 15 and a rounded radially inner end 16. The radially inner ends 16 project into the bore 10 and the radially outer ends 15 are substantially flush with the radially outer surface 12 of the body 6. If desired, means in the form of a hoop extending about the body 12 may be provided to prevent accidental dislodgement of the pins 14. The hoop may be of any suitable material, for example a thin copper alloy or of plastics.

The radially inner ends 16 of the pins 14 rest on a first cylindrical region 17 of an actuating member 18. The actuating member 18 includes a second cylindrical region 19 and a third cylindrical region 20 both of which are a snug fit within the cylindrical bore 10. The cylindrical region 17 is connected to the cylindrical region 19 by a tapering region 21. Upon movement of the actuating member 18 to the right as viewed in the drawing the pins 14 will be cammed radially outwardly by contact of the radially inner ends 16 with the tapering region 21 with the result that the radially outer ends 15 of the pins will be driven into locking engagement with the wall of the chamber of the gun. The amount of axial movement available to the actuating member is sufficient for the actuating member to be driven to a position in which the radially inner ends 16 of the locking pins rest against the cylindrical region 19 of the actuating member. Accordingly, once the actuating member has arrived at this position it cannot be cammed in the reverse direction by the radially inward force which is applied to the pins 14 by virtue of their engagement with the chamber wall.

A piston 22 is formed integrally with the actuating member 18 and operates in the cylindrical bore 20. In order to drive the piston, and with it the actuating member, an explosive charge is provided by means of a blank cartridge 23 which is positioned within an end region of the bore 10 and is held in position by means of a cap 24 which screw threadingly engages the exterior surface of the body 6. The piston 22 is sized to be tight fit within the bore 10 so that upon detonation of the cartridge 23 there is minimum passage of gasses past the piston. The entire explosive force of the cartridge is accordingly contained between the piston 22 and the cartridge case and the piston is driven to the right as viewed in the drawing with sufficient force to move the actuating member to the right to set the locking device as described above.

Detonation of the cartridge 23 is achieved by means of a firing pin 25 which abuts an end plate 26. A pair of Belleville washers 27 are located between the plate 26 and the cap 24 so that upon application of a steadily increased force to the exposed end of the plate 26 there will be little movement of the plate 26 until the force of the Belleville washers 27 is overcome, whereupon the plate 26 will snap to the right as viewed in the drawing applying a percussive force to the firing pin 25 to detonate the cartridge.

Preferably, a plastics protective sleeve is positioned over the cap 24 and the plate 26 in order to ensure that if the security device is dropped on the floor or otherwise accidentally knocked the cartridge will not be detonated. It will be noted, however, that in the event of accidental detonation of the cartridge there is no risk that the pins 15 will be propelled out of their associated bores because there is minimal flow of gas past the piston 22 and accordingly after the pins have reached the top of the tapered region 21 there will be no further force available to drive them from the body. The retaining hoop over the pins will absorb any kinetic energy posed by the pins at this point.

Whilst the invention has been described with particular reference to a security device for a gun it will be appreciated that the locking device of the present invention if of general applicability and may be used for any purpose where a rapid, reliable, and permanent closure of a hole is required.

We claim:

1. A locking device which, upon actuation, is locked to a hollow body within which the device is situated, the locking device comprising: a body having a central longitudinal bore and a plurality of radial passages extending from the bore radially outwardly to the surface of the body; a locking pin located in each passage with the radially inner end of each pin located extending into the bore; an actuating member located in the bore, the actuating member having a cylindrical region and a tapering region which tapers inwardly from the cylindrical region and being positioned such that upon axial movement of the actuating member the locking pins will be cammed radially outwardly by the tapering region and thereafter locked in a radial outward position by the cylindrical region; a piston mounted in a cylinder and coupled to the actuating member for axially moving the actuating member; an explosive charge for driving the piston; and means for detonating the explosive charge in response to application of axial force to one end of the device.

2. A locking device according to claim 1 incorporating means allowing the locking device to be releasably secured in the hollow body.

3. A locking device according to claim 2 wherein said means allowing the locking device to be releasably secured in the hollow body comprises a key operated means for radially expanding the locking device into engagement with the hollow body.

4. A locking device according to claim 1 wherein the radially outer end of each pin is pointed.

5. A locking device according to claim 1, wherein a hoop of suitable material is provided about the body of the locking device for preventing accidental dislodgement of the pins.

6. A locking device according to claim 1, wherein the cylinder in which the piston is mounted is part of the longitudinal bore of the body.

7. A locking device according to claim 1, wherein the means for detonating the explosive charge comprises a firing pin and means for resisting movement of the firing pin towards the explosive charge until a force in excess of a predetermined level is applied to the device.

8. A locking device according to claim 7 wherein at least one Belleville washer resists movement of the firing pin towards the explosive charge until a force in excess of the predetermined level is applied to the device whereupon the Belleville washer snaps to an inverted form thereby allowing the firing pin to apply a percussive force to the explosive charge.

* * * * *